US007019769B2

(12) United States Patent
Kerr

(10) Patent No.: US 7,019,769 B2
(45) **Date of Patent: *Mar. 28, 2006**

(54) IMAGING DRUM WITH IMPROVED MATERIAL HOLDING

(75) Inventor: Roger S. Kerr, Brockport, NY (US)

(73) Assignee: Eastman Kodak Company, Rochester, NY (US)

( * ) Notice: Subject to any disclaimer, the term of this patent is extended or adjusted under 35 U.S.C. 154(b) by 922 days.

This patent is subject to a terminal disclaimer.

(21) Appl. No.: 10/021,604

(22) Filed: Dec. 12, 2001

(65) Prior Publication Data

US 2003/0107752 A1 Jun. 12, 2003

(51) Int. Cl.
*B41J 2/435* (2006.01)

(52) U.S. Cl. ..... 347/262; 347/264

(58) Field of Classification Search ..... 346/103, 346/138; 347/153, 220–221, 262, 264, 225
See application file for complete search history.

(56) References Cited

U.S. PATENT DOCUMENTS

| | | | | |
|---|---|---|---|---|
| 5,755,520 | A | 5/1998 | Furlani et al. | 400/354 |
| 5,777,658 | A | 7/1998 | Kerr et al. | 347/215 |
| 6,639,622 | B1 * | 10/2003 | Kerr | 347/264 |

* cited by examiner

*Primary Examiner*—Hai Pham
(74) *Attorney, Agent, or Firm*—Nelson Adrian Blish

(57) ABSTRACT

An image processing apparatus (10) for writing images to print media (32), which comprises an imaging drum (300) for supporting the print media (32), wherein the imaging drum (300) has a surface, a drive end wall (310), and a vacuum end wall. A printhead (500) is used for forming an image onto the print media (32). A motor rotates the imaging drum (300) and a blower creates a vacuum supply to the imaging drum (300) for holding the print media (32) on the surface. At least one vacuum piston (504) creates a second vacuum supply (508) to the surface, wherein the vacuum piston (504) is mounted in the drive end wall (310) or the vacuum end wall, or if more than one vacuum piston (504) is used, optionally in both walls.

21 Claims, 4 Drawing Sheets

IMAGING DRUM WITH IMPROVED MATERIAL HOLDING

FIELD OF THE INVENTION

The present invention relates to an image processing apparatus and method for exposing an intended image on an imaging drum to form a pre-press proof used in the printing industry but not limited to, and, more particular, to an image processing apparatus incorporating an imaging drum having improved print media holding capabilities.

BACKGROUND OF THE INVENTION

Pre-press color-proofing is a procedure that is used mainly by the printing industry for creating representative images of printed material without the high cost and time that is required to actually produce printing plates and set up a high-speed, high volume, printing press to produce an example of an intended image. An image may require several corrections and be reproduced several times to satisfy or meet customers requirements resulting in a large loss of profits and ultimately, higher costs to the customer.

One such commercially available image processing apparatus is arranged to form an intended image on a sheet of print media. Dye is transferred, from a sheet of dye donor material to the print media by applying a sufficient amount of thermal energy to the dye donor sheet material to form the intended image. This image processing apparatus generally includes a material supply assembly or carousel, and a lathe bed scanning subsystem or write engine, which includes a lathe bed scanning frame, translation drive, translation stage member, printhead, load roller, imaging drum, print media exit transport, and dye donor sheet material exit transport.

Operation of the image processing apparatus includes metering a length of the print media (in roll form) from the material assembly or carousel. The print media is then cut into sheet form of the required length and transported to the imaging drum. It is then wrapped around and secured onto the imaging drum. A load roller, which is also known as a squeegee roller, removes entrained air between the imaging drum and the print media or the print media dye donor material. Next, a length of dye donor material (in roll form) is metered out of the material supply assembly or carousel, and cut into sheet form of the required length. It is then transported to the imaging drum and wrapped around the periphery of the imaging drum. The load roller removes any air entrained between the imaging drum, print media, and the dye donor material. The dye donor material is superposed in the desired registration with respect to the print media, which has already been secured to the imaging drum.

After the dye donor sheet material is secured to the periphery of the imaging drum, the scanning subsystem or write engine, provides the scanning function. This is accomplished by retaining the print media and the dye donor sheet material on the imaging drum while it is rotated past the printhead to form an intended image on the print media. The translation drive then traverses both the printhead and translation stage member axially along the axis of the imaging drum in coordinated motion with the rotating imaging drum. These movements combine to produce the intended image on the print media.

After the intended image has been formed on the print media, the dye donor sheet material is removed from the imaging drum without disturbing the print media beneath it. The dye donor sheet material is then transported out of the image processing apparatus to a waste bin. Additional dye donor sheet materials are sequentially superimposed with the print media on the imaging drum, further producing an intended image. The completed intended image on the print media is then unloaded from the imaging drum and transported to an external holding tray on the image processing apparatus.

Various patents are considered relevant to this invention including commonly owned U.S. Pat. Nos. 5,777,658 and 5,755,520, which is hereby incorporated by reference.

Although the presently known and utilized image processing apparatus is satisfactory, a need exists to improve the capability of the imaging drum to hold print media at high rotational speeds thus improving throughput of utilized image processing apparatus.

SUMMARY OF THE INVENTION

The invention relates to an image processing apparatus for writing images to print media, which comprises an imaging drum for supporting the print media, wherein the imaging drum has a surface, a drive end wall, and a vacuum end wall. A printhead is used for forming an image onto the print media. A motor rotates the imaging drum and a blower creates a vacuum supply to the imaging drum for holding the print media on the surface. At least one vacuum piston creates a second vacuum supply to the surface, wherein the vacuum piston is mounted in the drive end wall or the vacuum end wall, or if more than one vacuum piston is used, optionally in both walls.

The invention also relates to a method for loading and unloading print media from an imaging drum having a surface, a drive end wall and a vacuum end wall, which comprises creating a first vacuum on the surface of the imaging drum; rotating the imaging drum; loading print media onto the surface; holding the print media onto the surface by a vacuum supply which engages vacuum holes connecting to a hollowed-out interior portion of the imaging drum, and using a vacuum piston for forming a second vacuum supply during the rotation to the vacuum holes.

The invention also relates to an imaging drum for supporting print media, which comprises a surface and a hollowed-out interior portion; a plurality of vacuum holes in the surface; a drive end wall and a vacuum end wall connected to the surface; a first vacuum supply for holding print media onto the surface through the plurality of vacuum holes; and a second vacuum supply for holding print media onto the surface provided by at least one vacuum piston mounted in one of the walls for creating a second vacuum supply to the plurality of vacuum holes.

BRIEF DESCRIPTION OF THE DRAWINGS

A more complete understanding of the invention and its advantages will become apparent from the detailed description taken in conjunction with the accompanying drawings, wherein examples of the invention are shown, and identical reference numbers have been used, where possible, to designate identical elements that are common to the figures referenced below.

DETAILED DESCRIPTION OF THE INVENTION

Figure 1:
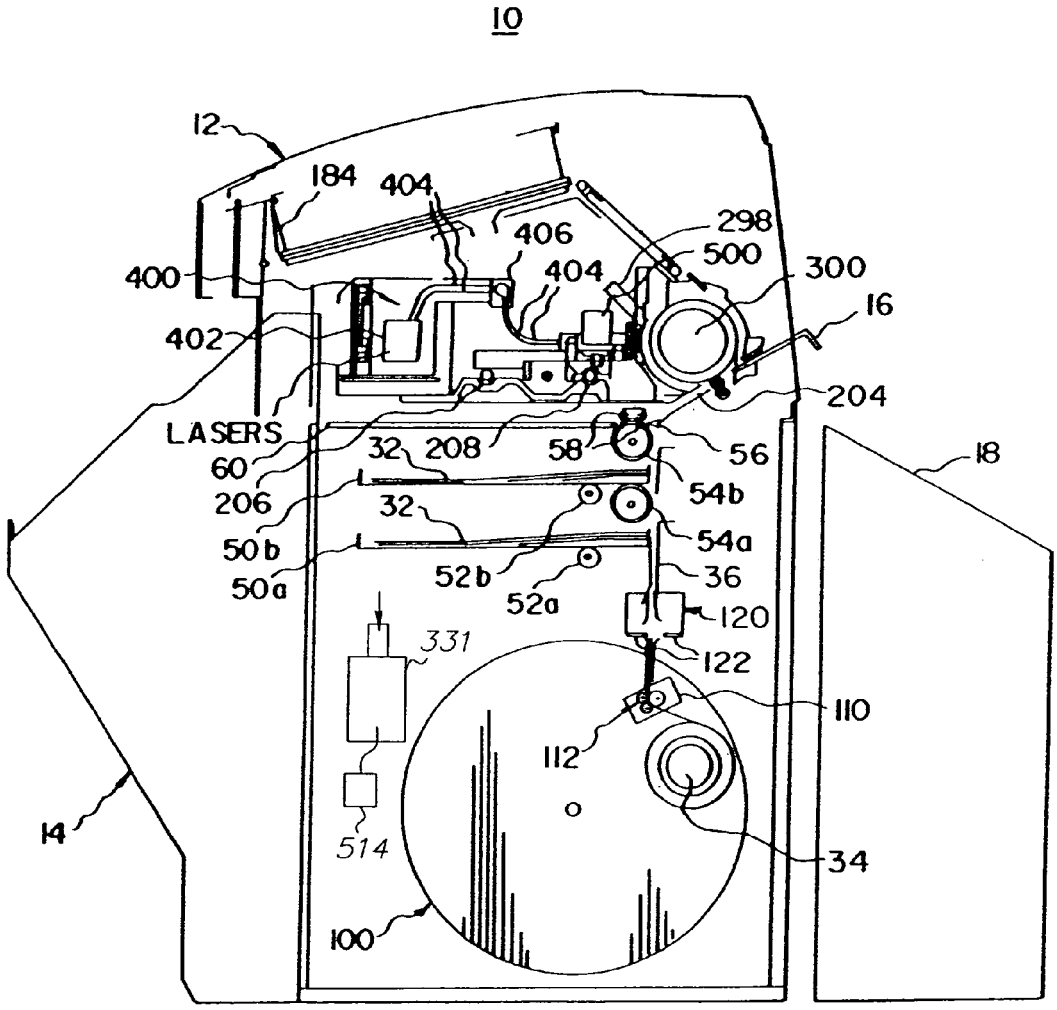
FIG. 1 is a side view in vertical cross-section of an image processing apparatus according to the present invention.

In the following description, like reference characters designate like or corresponding parts throughout the several views. Also, in the following description, it is to be understood that such terms as "front," "rear," "lower," "upper," and the like are words of convenience and are not to be construed as limiting terms. Referring to the drawings, the invention will be described in more detail. It should be understood that while the invention will be described as a rotation stop for a linear motor used in a linear translation system it could be utilized to provide a means to prevent rotation for other applications well known in the art.

Turning first to FIG. 1, an image processing apparatus according to the present invention, which is generally referred to as 10, includes an image processor housing 12, which provides a protective cover for the apparatus. The apparatus 10 also includes a hinged image processor door 14, which is attached to the front portion of the image processor housing 12 and permits access to the two sheet material trays. A lower sheet print material tray 50*a* and upper sheet input print material tray 50*b* are positioned in the interior portion of the image processor housing 12 for supporting print media 32, or an input image, thereon. Only one of the sheet material trays will dispense the print media 32 out of the sheet material tray to create an intended image thereon. The alternate sheet material tray either holds an alternative type of print media 32, or an input image, or functions as a back up sheet material tray. In this regard, lower sheet material tray 50*a* includes a lower print media lift cam 52*a*, which is used to lift the lower sheet material tray 50*a* and, ultimately, the print media 32 upwardly toward lower print media roller 54*a* and upper print media roller 54*b*. When the print media rollers 54*a* and 54*b* are both rotated, the print media 32 is pulled upwardly towards a print media guide 56. The upper sheet input image material tray 50*b* includes an upper print media lift cam 52*b* for lifting the upper sheet print material tray 50*b* and, ultimately, the print media 32 towards the upper print media roller 54*b*, which directs it toward the print media guide 56.

Continuing with FIG. 1, the movable print media guide 56 directs the print media 32 under a pair of print media guide rollers 58. This engages the print media 32 for assisting the upper print media roller 54*b* in directing it onto the print media staging tray 60. The print media guide 56 is attached and hinged to the lathe bed scanning frame 202 at one end, and is uninhibited at its other end for permitting multiple positioning of the print media guide 56. The print media guide 56 then rotates the uninhibited end downwardly, as illustrated. The direction of rotation of the upper print media roller 54*b* is reversed for moving the print medium receiver sheet material 32, which is resting on the print media staging tray 60, under the pair of print media guide rollers 58 upwardly through an entrance passageway 204 and up to the imaging drum 300.

A roll of dye donor material 34 is connected to the print media carousel 100 in a lower portion of the image processor housing 12, as shown in FIG. 1. Four rolls are ordinarily used, but, for clarity and each roll includes a dye donor material 34 of a different color, typically black, yellow, magenta and cyan. These dye donor materials 34 are ultimately cut into dye donor sheet materials 36 and passed to the imaging drum 300 for forming the medium from which dyes embedded therein are passed to the print media 32 resting thereon. In this regard, a print media drive mechanism 110 is attached to each roll of dye donor material 34, and includes three print media drive rollers 112 through which the dye donor material 34 of interest is metered upwardly into a print media knife assembly 120. After the dye donor material 34 reaches a predetermined position, the print media drive rollers 112 cease driving the dye donor material 34. Two print media knife blades 122 positioned at the bottom portion of the print media knife assembly 120 cut the dye donor material 34 into dye donor sheet materials 36. The lower print media roller 54*a* and the upper print media roller 54*b* along with the print media guide 56 then pass the dye donor sheet material 36 onto the print media staging tray 60 and ultimately to the imaging drum 300.

As shown in FIG. 1, a laser assembly 400 includes a quantity of laser diodes 402 in its interior. The lasers are connected via fiber optic cables 404 to a distribution block 406 and ultimately to a printhead 500. The printhead 500 directs thermal energy received from the laser diodes 402. This causes the dye donor sheet material 36 to pass the desired color across the gap to the print media 32. The printhead 500 attaches to a lead screw 250 (see FIG. 2). A lead screw drive nut 254 and drive coupling (not shown) permit axial movement along the longitudinal axis of the imaging drum 300 for transferring the data to create the intended image onto the print media 32.

For writing, the imaging drum 300 rotates at a constant velocity. The printhead 500 begins at one end of the print media 32 and traverses the entire length of the print media 32 for completing the transfer process for the particular dye donor sheet material 36 resting on the print media 32. After the printhead 500 completes the transfer process for the particular dye donor sheet material 36 resting on the print media 32, the dye donor sheet material 36 is removed from the imaging drum 300 and transferred out of the image processor housing 12 via a skive or ejection chute 16. The dye donor sheet material 36 eventually comes to rest in a waste bin 18 for removal by the user. The above-described process is then repeated for the other three rolls of dye donor materials 34.

Continuing with FIG. 1, after the color from all four sheets of the dye donor sheet materials 36 has been transferred, the dye donor sheet material 36 is removed from the imaging drum 300. The print media 32 with the intended image thereon is then removed from the imaging drum 300 and transported via a transport mechanism (not shown) out of the image processor housing 12 and comes to rest against a print media stop.

After the dye donor sheet material 36 is secured to the periphery of the imaging drum 300, the lathe bed scanning subsystem 200 or write engine provides the scanning function. This is accomplished by retaining the print media 32 and the dye donor sheet material 36 on the imaging drum 300 while it is rotated past the printhead 500 that will expose the print media 32. The translator drive 258 then traverses the printhead 500 and translation stage member 220 axially along the axis of the imaging drum in coordinated motion with the rotating imaging drum 300. These movements combine to produce the intended image on the print media 32.

Figure 2:
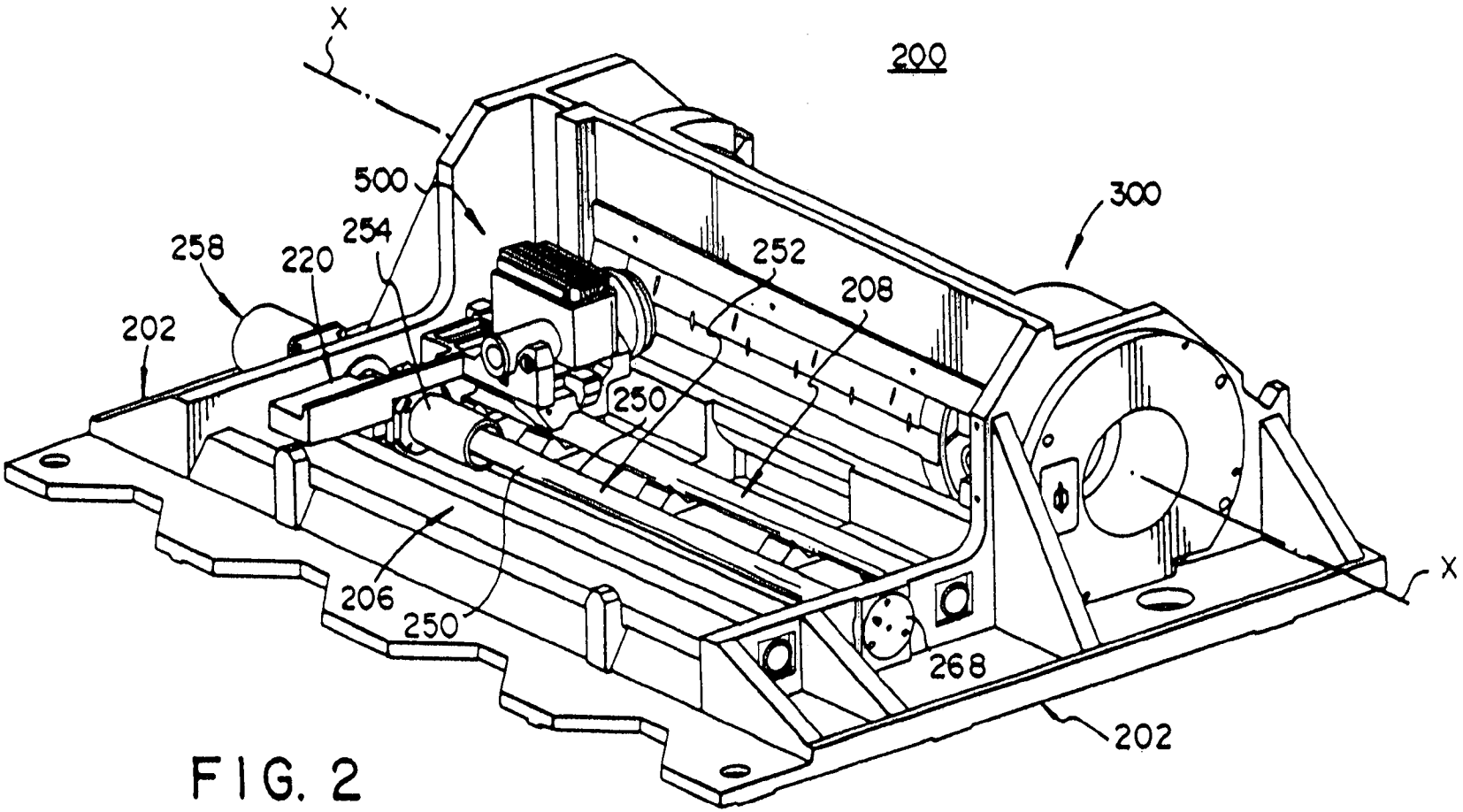
FIG. 2 shows details of the imaging drum with a printhead as mounted according to the invention.

Turning to FIG. 2, the image processing apparatus 10 includes the imaging drum 300, printhead 500, and lead screw 250, which are assembled in the lathe bed scanning frame 202. The imaging drum 300 is mounted for rotation about an axis X in the lathe bed scanning frame 202. The printhead 500 is movable with respect to the imaging drum 300, and is arranged to direct a beam of light to the dye donor sheet material 36. The beam of light from the printhead 500 for each laser diode 402 (shown in FIG. 1) is modulated individually by modulated electronic signals from the image processing apparatus 10. These are representative of the shape and color of the original image. The color on the dye donor sheet material 36 is heated to cause volatilization only in those areas in which its presence is required on the print media 32 to reconstruct the shape and color of the original image.

Continuing with FIG. 2, the printhead 500 is mounted on a movable translation stage member 220, which is supported for low friction movement on translation bearing rods 206, 208. The linear translation subsystem includes the translation stage member 220, the translation bearing rods 206, 208, and the translator drive 258. The translation bearing rods 206, 208 are sufficiently rigid so as not sag or distort between mounting points and are arranged as parallel as possible with the axis X of the imaging drum 300, with the axis of the printhead 500 perpendicular to the axis X of the imaging drum 300 axis. The front translation bearing rod 208 locates the translation stage member 220 in the vertical and the horizontal directions with respect to axis X of the imaging drum 300. The rear translation bearing rod 206 locates the translation stage member 220 only with respect to rotation of the translation stage member 220 about the front translation bearing rod 208. This is done so that there is no over-constraint of the translation stage member 220, which might cause it to bind, chatter, or otherwise impart undesirable vibration or jitters to the printhead 500 during the generation of an intended image. The translator drive 258 traverses the translation stage member and printhead axially along the imaging drum.

Figure 3:
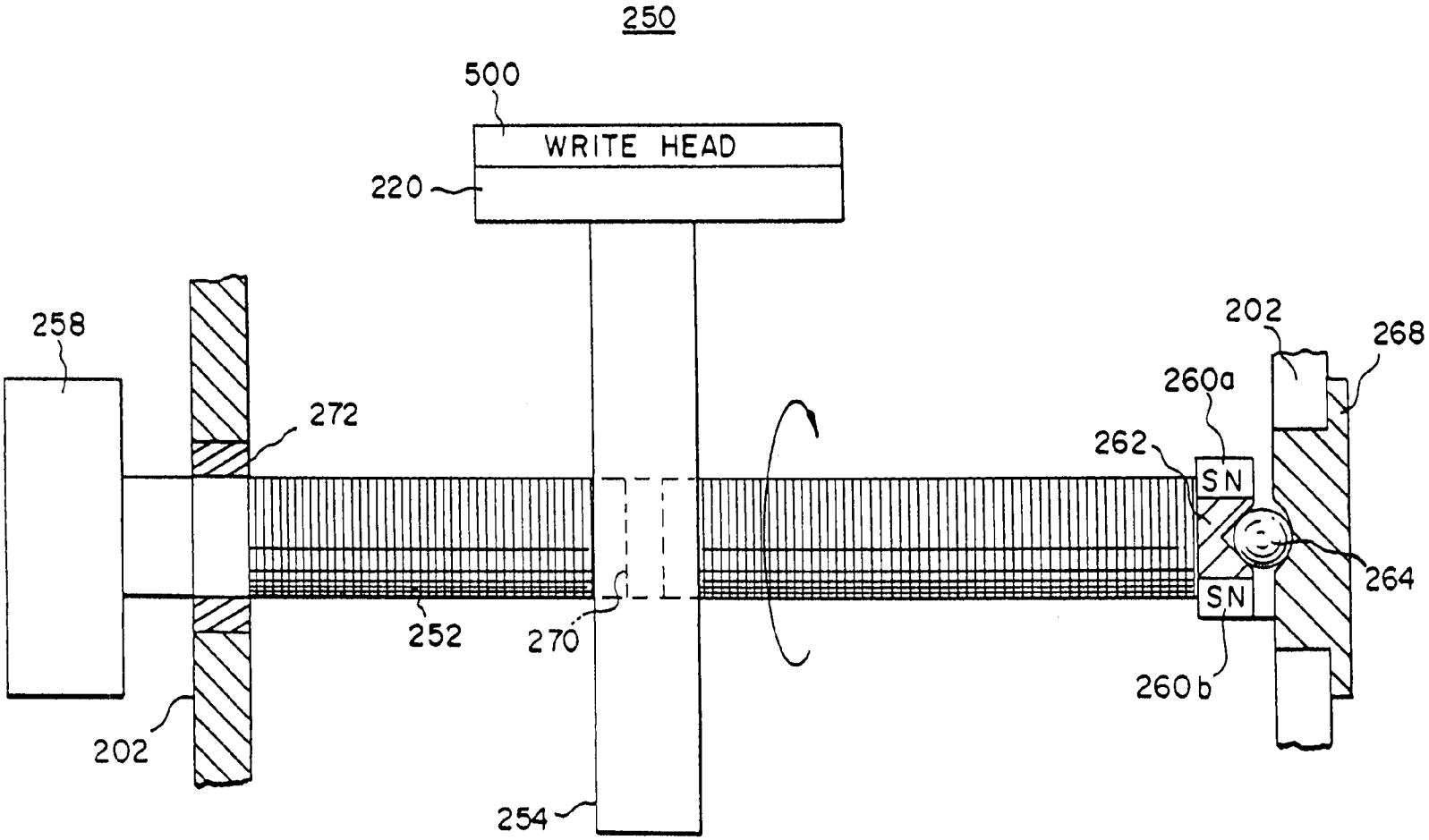
FIG. 3 shows the imaging drum with printhead.
Figure 4:
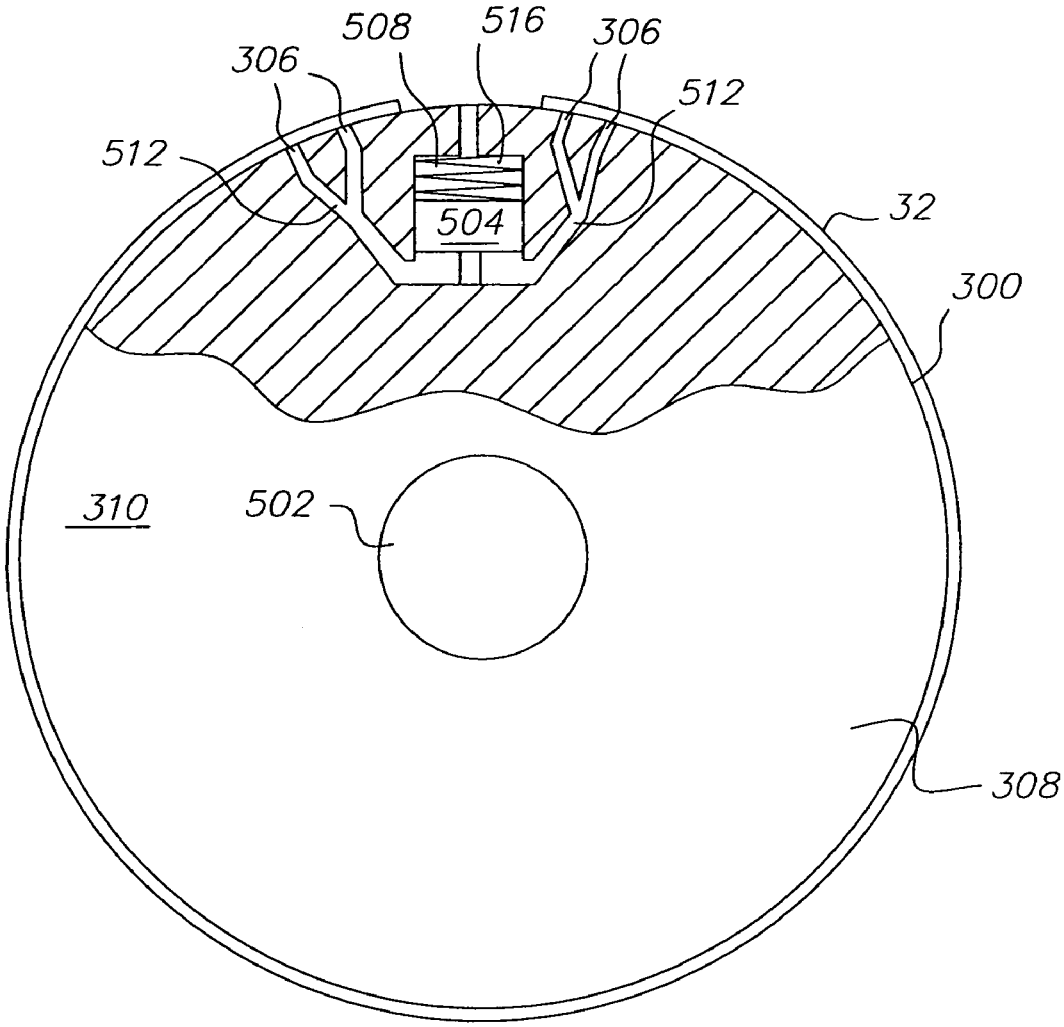
FIG. 4 is a partial end view of the imaging drum sectioned to show the detail of the, wall mounted piston of the invention.

Referring to FIGS. 2 and 3, the lead screw 250 includes an elongated, threaded shaft 252, which is attached to the translator linear motor 258 on its drive end and to the lathe bed scanning frame 202 by means of a radial bearing 272. A lead screw drive nut 254 includes grooves in its hollowed-out center portion 270 for mating with the threads of the threaded shaft 252. This allows the lead screw drive nut 254 axial movement along the threaded shaft 252 as the threaded shaft 252 is rotated by the linear motor 258. The lead screw drive nut 254 is integrally attached to the printhead 500 through the lead screw coupling (not shown) and the translation stage member 220 at its periphery, so that the threaded shaft 252 is rotated by the linear motor 258. This moves the lead screw drive nut 254 axially along the threaded shaft 252, which in turn moves the translation stage member 220, and ultimately the printhead 500 axially along the imaging drum 300.

As best illustrated in FIG. 3, an annular-shaped axial load magnet 260*a* is integrally attached to the driven end of the threaded shaft 252, and is in a spaced-apart relationship with another annular-shaped axial load magnet 260*b* attached to the lathe bed scanning frame 202. The axial load magnets 260*a* and 260*b* are preferably made of rare-earth materials such as neodymium-iron-boron. A generally circular-shaped boss 262 part of the threaded shaft 252 rests in the hollowed-out portion of the annular-shaped axial load magnet 260*a*, and includes a generally V-shaped surface at the end for receiving a ball bearing 264. A circular-shaped insert is placed in the hollowed-out portion of the other annular-shaped axial load magnet 260*b*. It has an accurate-shaped surface at one end for receiving ball bearing 264, and a flat surface at its other end for receiving an end cap 268 placed over the annular-shaped axial load magnet 260*b*, which is attached to the lathe bed-scanning frame 202 for protectively covering the annular-shaped axial load magnet 260*b*. This provides an axial stop for the lead screw 250.

Continuing with FIG. 3, the linear motor 258 is energized and imparts rotation to the lead screw 250, as indicated by the arrows. This causes the lead screw drive nut 254 to move axially along the threaded shaft 252. The annular-shaped axial load magnets 260*a*, 260*b* are magnetically attracted to each other, which prevents axial movement of the lead screw 250. The ball bearing 264, however, permits rotation of the lead screw 250 while maintaining the positional relationship of the annular-shaped axial load magnets, i.e., slightly spaced apart. Mechanical friction between them is thus prevented, yet the threaded shaft 252 can continue to rotate.

The printhead 500 travels in a path along the imaging drum 300, moving at a speed synchronous with the imaging drum 300 rotation and proportional to the width of the writing swath. The pattern transferred by the printhead 500 to the print media 32 along the imaging drum 300 is a helix.

In operation, the lathe bed scanning subsystem 200 or write engine contains the mechanisms that provide the mechanical actuations for the imaging drum positioning and motion control to facilitate placement of loading onto, and removal of the print media 32 and the dye donor sheet material 36 from the imaging drum 300. The lathe bed scanning subsystem 200 or write engine provides the scanning function by retaining the print media 32 and dye donor sheet material 36 on the rotating imaging drum 300. This generates a once per revolution timing signal to the data path electronics as a clock signal, while the translator drive 258 traverses the translation stage member 220 and printhead 500 axially along the imaging drum 300 in a coordinated motion with the imaging drum rotating past the printhead. Positional accuracy is maintained in order to control the placement of each pixel, so that the intended image produced on the print media is precise.

During operation, the lathe bed scanning frame 202 supports the imaging drum and its rotational drive. The translation stage member 220 and write head are supported by the two translation bearing rods 206, 208 that are positioned parallel to the imaging drum and lead screw. They are parallel to each other and form a plane therein, along with the imaging drum and lead screw. The translation bearing rods are, in turn, supported by the outside walls of the lathe bed scanning frame of the lathe bed scanning subsystem or write engine. The translation bearing rods are positioned and aligned there between.

The translation drive 258 is for permitting relative movement of the printhead 500 by means of a DC servomotor and encoder, which rotates the lead screw 250 parallel with the axis of the imaging drum 300. The printhead 500 is placed on the translation stage member 220 in the "V" shaped grooves. The "V" shaped grooves are in precise relationship to the bearings for the front translation stage member 220 supported by the front and rear translation bearing rods 206, 208. The translation bearing rods are positioned parallel to the imaging drum 300. The printhead is selectively locatable with respect to the translation stage member; thus it is positioned with respect to the imaging drum surface. The printhead has a means of adjusting the distance between the printhead and the imaging drum surface, and the angular position of the printhead about its axis using adjustment screws. An extension spring provides a load against these two adjustment means. The translation stage member 220 and printhead 500 are attached to the rotational lead screw 250, which has a threaded shaft, by a drive nut and coupling. The coupling is arranged to accommodate misalignment of the drive nut and lead screw so that only forces parallel to the linear lead screw and rotational forces are imparted to the translation stage member by the lead screw and drive nut.

The lead screw rests between two sides of the lathe bed scanning frame 202, where it is supported by deep groove radial bearings. At the drive end, the lead screw 250 continues through the deep groove radial bearing through a pair of spring retainers. The spring retainers are separated and loaded by a compression spring, and to a DC servomotor and encoder. The DC servomotor induces rotation to the lead screw 250, which moves the translation stage member 220 and printhead 500 along the threaded shaft as the lead screw 250 is rotated. Lateral movement of the printhead 500 is controlled by switching the direction of rotation of the DC servomotor and thus the lead screw 250.

The printhead 500 includes a number of laser diodes 402, which are tied to the printhead and can be individually modulated to supply energy to selected areas of the print media 32 in accordance with an information signal. The printhead 500 of the image processing apparatus 10 includes a plurality of optical fibers, which are coupled to the laser diodes 402 at one end and at the opposite end to a fiber optic array within the printhead. The printhead 500 is movable relative to the longitudinal axis of the imaging drum 300. The dye is transferred to the print media 32 as radiation is transferred from the laser diodes by the optical fibers to the printhead, and thus to the dye donor sheet material 36, and is converted to thermal energy in the dye donor sheet material.

Accordingly, the present invention provides a process and image processing apparatus 10 for consistently, quickly and accurately generating an intended image utilizing such an image processing apparatus 10 to create high quality, accurate, and consistent images, which process and image processing apparatus 10 is substantially automated to improve the control, quality and productivity of the process while minimizing the attendance and labor necessary. Moreover, the image processing apparatus 10 is capable of not only generating this high quality intended image consistently, but is capable of creating a multicolor intended image which is in registration regardless of how the various individual images are supplied to the print media 32 comprising the final intended image. Thus, the present invention provides both a process and apparatus in which the various dye donor sheet materials 36 are sequentially superposed with a single print media 32 and then removed.

The invention is for an image processing apparatus 10 for writing an intended image to print media 32 having an imaging drum 300 for supporting print media 32, where the imaging drum 300 has a drive end wall 310 and a vacuum end wall. In one embodiment, a printhead 500 can be used for forming an intended image onto the print media 32. A motor is used for rotating the imaging drum 300. A blower 331 is used for creating a first vacuum supply 502 to the imaging drum 300 and the vacuum holds the print media 32 onto a surface of imaging drum 300. At least one of the first vacuum piston 504 or second vacuum piston (not shown) are used for creating a second vacuum supply 508 to the imaging drum 300, first vacuum piston 504 or second vacuum piston are mounted in drive end wall 310 and a vacuum end wall, or in both drive end wall 310 or vacuum end wall 308.

In one embodiment of the invention, the first vacuum supply 502 and the second vacuum supply 508 can be reduced for loading print media 32 onto the surface of the imaging drum 300.

In another embodiment of the invention, two vacuum pistons can be used, a first vacuum piston 504 and a second vacuum piston. As one embodiment, the first vacuum piston 504 can be mounted in the drive end wall 310 and the second vacuum piston is mounted in the vacuum end wall. It is also within the scope of the invention to have a plurality of vacuum pistons disposed on either the drive end wall 310 or the vacuum end wall 308 or both.

The first vacuum piston, 504 upon rotation of the imaging drum 300, creates a vacuum chamber which communicates with at least one evacuation passage 512, which could be more than one evacuation passage 512 which provides a second vacuum supply 508 to the surface of the imaging drum 300. The first vacuum supply 502 to the surface of the imaging drum 300 can be modified by the rotational speed of the imaging drum 300, or by using a vacuum supply controller 514. If a vacuum supply controller is used, it can change the speed of the blower by pulse width modulation of a DC voltage level to blower.

In another embodiment of the invention, the image processing apparatus 10 can utilize print media 32, which is covered by a dye donor sheet material 36.

It is also contemplated that the image processing apparatus 10 of the invention could be, either a laser thermal printer, film writer or an inkjet printer.

The invention relates to a method for loading and unloading print media 32 from an imaging drum 300, which consists of creating a vacuum supply 502 in the imaging drum; rotating the imaging drum 300 The print media 32 is loaded on a surface of the imaging drum 300 wherein the print media 32 is held onto the surface of the imaging drum 300 by vacuum holes 306 connecting a hollowed-out interior portion of the imaging drum 300 to the surface. The imaging drum 300 is rotated using a first vacuum piston 504 for forming a second vacuum supply 508 during the rotation to the vacuum holes 306.

The method can include the additional steps of slowing the rotation of the imaging drum 300 thereby decreasing the second vacuum supply 508 to the surface of the imaging drum 300; and unloading the print media 32.

The invention also relates to an imaging drum 300 for supporting print media 32, which comprises a surface and a hollowed-out interior portion; a plurality of vacuum holes 306 in the surface of the imaging drum 300; a drive end wall 310 and a vacuum end wall connected to the surface of the imaging drum 300; first vacuum supply 502 for holding print media 32 onto the surface through the plurality of vacuum holes 306; and at least one vacuum piston 504 mounted in one of the end walls 310 or for creating a second vacuum supply 508 to the plurality of vacuum holes 306 and having a spring 516 to return the vacuum pistons 504.

The imaging drum 300 operates wherein the first vacuum supply 502 and the second vacuum supply 508 are reduced for loading print media 32 onto the surface of the imaging drum 300.

The imaging drum 300 can be constructed to have a first vacuum piston 504 mounted in the drive end wall 310 and a second vacuum piston mounted in the vacuum end wall. Alternatively, The imaging drum 300 can also be constructed to have a plurality of vacuum pistons mounted on the drive end wall 310 or the vacuum end wall, or both.

The imaging drum 300 upon rotation preferably forms a vacuum chamber, which communicates with at least one evacuation passage 512, which provides the second vacuum supply 508 to the surface of the imaging drum 300.

The imaging drum 300 can also be constructed wherein the first vacuum supply 502 is varied using a vacuum supply controller. Alternatively, the first or second, or both vacuum supplies can be varied by changing the rotational speed of the imaging drum 300. It should be known that dye could be colorant, ink or pigment The invention has been described in detail with particular reference to certain preferred embodiments thereof, but it will be understood that variations and modifications can be effected within the spirit and scope of the invention as described hereinabove and as defined in the appended claims by a person of ordinary skill in the art, without departing from the scope of the invention. While preferred embodiments of the invention have been described using specific terms, this description is for illustrative purposes only. It is intended that the doctrine of equivalents be relied upon to determine the fair scope of these claims in connection with any other person's product which fall outside the literal wording of these claims, but which in reality do not materially depart from this invention.

PARTS LIST

10. Image processing apparatus
12. Image processor housing
14. Image processor door
16. Donor ejection chute
18. Donor waste bin
32. Print media
34. Dye donor roll material
36. Dye donor sheet material
46. Material feed assembly
48. Driven roll
50*a*. Lower sheet print material tray
50*b*. Upper sheet print material tray
52*a*. Lower print media lift cam
52*b*. Upper print media lift cam
54*a*. Lower print media roller
54*b*. Upper print media roller
56. Print media guide
58. Print media guide rollers
60. Print media staging tray
100. Print media carousel
110. Print media drive mechanism
112. Print media drive rollers
120. Print media knife assembly
122. Print media knife blades
200. Lathe bed scanning subsystem
202. Lathe bed scanning frame
204. Entrance passageway
206. Rear translation bearing rod
208. Front translation bearing rod
220. Translation stage member
250. Lead screw
252. Threaded shaft
254. Lead screw drive nut
258. Translator drive linear motor
260*a*. Axial load magnet
260*b*. Axial load magnet
262. Circular-shaped boss
264. Ball bearing
268. End cap
270. Hollowed-out center portion
272. Radial bearing
300. Imaging drum
306. Vacuum holes
310. Drive end wall
400. Laser assembly
402. Laser diodes
404. Fiber optic cables
406. Distribution block
500. Printhead
502. First vacuum supply
504. First vacuum piston
508. Second vacuum supply
512. Evacuation passages
516. Spring

What is claimed is:

1. An image processing apparatus for writing images to print media comprising:

an imaging drum for supporting said print media having a drive end wall and a vacuum end wall;

a print head for forming an image onto said print media;

a motor for rotating said imaging drum;

a blower for creating a vacuum supply to said imaging drum for holding said print media on said imaging drum; and at least one vacuum piston for creating a second vacuum supply to said surface, wherein said vacuum piston is mounted in said drive end wall or said vacuum end wall.

2. The image processing apparatus according to claim 1, wherein said vacuum supply and said second vacuum supply are reduced for loading said print media.

3. The image processing apparatus according to claim 1, wherein said at least one vacuum piston consists of a first vacuum piston and a second vacuum piston, and wherein said first vacuum piston is mounted in said drive end wall and said second vacuum piston is mounted in said vacuum end wall.

4. The image processing apparatus according to claim 1, wherein a plurality of vacuum pistons are disposed on either said drive end wall or said vacuum end wall.

5. The image processing apparatus according to claim 1, wherein said at least one vacuum piston upon rotation of the imaging drum, forms a vacuum chamber which communicates with at least one evacuation passage thereby providing a second vacuum supply to the surface.

6. The image processing apparatus according to claim 1, wherein said vacuum supply is varied using a vacuum supply controller.

7. The image processing apparatus according to claim 1, wherein said second vacuum supply varies with the imaging drum rotational speed.

8. The image processing apparatus according to claim 6, wherein said vacuum supply controller changes the speed of said blower by pulse width modulation of a DC voltage level to said blower.

9. The image processing apparatus according to claim 1, wherein said print media is covered by a dye donor material.

10. The image processing apparatus according to claim 1, wherein said image processing apparatus is a laser thermal printer.

11. The image processing apparatus according to claim 1, wherein a dye donor material overlays said print media and said printhead writes an image to said print media by transferring from said dye donor material to said print media.

12. The image processing apparatus according to claim 1 wherein the image processing apparatus is a film writer.

13. A method for loading and unloading print media from an imaging drum having a surface, a drive end wall and a vacuum end wall, comprising the steps of:

creating a vacuum supply on said surface of said imaging drum;

rotating said imaging drum;

loading print media onto said surface;

holding said print media onto said surface by said vacuum supply which engages vacuum holes connecting to a hollowed-out interior portion of said imaging drum; and using a vacuum piston for forming a second vacuum supply during said rotation to said vacuum holes.

14. The method as in claim 13, comprising the additional steps of:

slowing said imaging drum thereby decreasing the second vacuum supply to the surface; and unloading said print media.

15. An imaging drum for supporting print media comprising:

an external surface and a hollowed-out interior portion;

a plurality of vacuum holes in said external surface;

a drive end wall and a vacuum end wall;

a first vacuum supply for holding print media onto said external surface through said plurality of vacuum holes; and a second vacuum supply for holding print media onto said external surface provided by at least one vacuum piston-mounted in one of said walls for creating a second vacuum supply to said plurality of vacuum holes.

16. The imaging drum according to claim 15, wherein said first vacuum supply and said second vacuum supply are reduced for loading print media onto said external surface.

17. The imaging drum according to claim 15, wherein said at least one vacuum piston consists of a first vacuum piston and a second vacuum piston, and wherein said first vacuum piston is mounted in said drive end wall and said second vacuum piston is mounted in said vacuum end wall.

18. The imaging drum according to claim 15, where a plurality of vacuum pistons are mounted on either said drive end wall or said vacuum end wall.

19. The imaging drum according to claim 15, wherein said at least one vacuum piston upon rotation of the imaging drum forms a vacuum chamber which communicates with at least one evacuation passage which provides the second vacuum supply to the external surface.

20. The imaging drum according to claim 15, wherein said first vacuum supply is varied using a vacuum supply controller.

21. The imaging drum according to claim 15, wherein said second vacuum supply varies with the imaging drum rotational speed.

* * * * *